United States Patent [19]

Litchfield et al.

[11] 4,392,696

[45] Jul. 12, 1983

[54] DRAWERS

[75] Inventors: Leon G. Litchfield; Terence Hardy, both of Belper, England

[73] Assignee: L.B. (Plastics) Limited, Belper, England

[21] Appl. No.: 202,090

[22] Filed: Oct. 30, 1980

[30] Foreign Application Priority Data

Nov. 2, 1979 [GB] United Kingdom ..... 7938123

[51] Int. Cl.[3] ..... A47B 88/00

[52] U.S. Cl. ..... 312/330 R; 312/333; 312/348

[58] Field of Search ..... 312/330 R, 333, 346, 312/348; 308/3.6, 3.8; 292/140, 143, 169

[56] References Cited

U.S. PATENT DOCUMENTS

| | | | |
|---|---|---|---|
| 2,614,022 | 10/1952 | Kurtzon | 312/348 |
| 2,698,214 | 12/1954 | Skamser | 312/346 |
| 2,731,321 | 1/1956 | Thompson | 312/348 |
| 4,037,885 | 7/1977 | Rock et al. | 308/3.8 |
| 4,162,114 | 7/1979 | Litchfield et al. | 312/330 R |
| 4,165,907 | 8/1979 | Rock et al. | 312/348 |
| 4,186,979 | 2/1980 | Litchfield | 312/333 |
| 4,190,306 | 2/1980 | Litchfield et al. | 312/333 |
| 4,196,943 | 4/1980 | Rock et al. | 308/3.8 |
| 4,298,234 | 11/1981 | Litchfield et al. | 308/3.8 |
| 4,304,449 | 12/1981 | Litchfield et al. | 308/3.6 |

*Primary Examiner*—Victor N. Sakran

*Attorney, Agent, or Firm*—W. Thad Adams, III

[57] ABSTRACT

A drawer with side walls provided with longitudinal tracks for engagement with drawer runners during use and a rear wall having a longitudinal track in which a pair of guide members are slidably located for movement between operative positions in which they extend across the rear ends of the tracks in the side walls and engage with the drawer runners and retracted positions in which they are arranged to retract clear of the rear ends of the runner tracks, there being rotary actuating means accessible from within the drawer to effect movement of said guide members between said positions, the actuating means incorporating locking means to retain the guide members against movement in their extended and retracted positions.

13 Claims, 9 Drawing Figures

DRAWERS

This invention relates to drawers.

The invention provides a drawer having longitudinal tracks in the opposite side walls thereof, a pair of members mounted one at each of the rear corners of the drawer and moveable between extended and retracted positions, said members being arranged to extend across the rear ends of the respective tracks in their operative positions and being arranged to retract clear of the rear ends of the tracks in their inoperative positions, and rotary actuating means accessible from within the drawer and operable to effect movement of said members between said positions said actuating means comprising a stud device having a head adapted to seat against the inner surface of the rear wall of the drawer and provided with a formation engageable by an actuating member or tool to enable rotation of the actuating device from within the drawer, a body portion rotatably received in an aperture in said rear wall, and an eccentric pin projecting from said body portion into engagement with the associated member to impart sliding movement thereto on rotation of said stud device, and said actuating means incorporating over-centre locking means operable to retain said members in their extended operative positions until released by rotation of the actuating means.

Advantageously the rear wall of the drawer is provided with a longitudinal track similar to those formed in the side walls, said members being slidably located in the track in the rear wall.

Preferably the members comprise guide members adapted in their operative positions to engage with respective runners on which the drawer is slidably supported in use. Alternatively the members may be stop members adapted in their extended positions to engage abutments serving to limit the extent to which the drawer can be opened.

Preferably also the drawer is adapted to be used in association with drawer runners having bearing members mounted at the forward ends thereof and adapted to engage within said tracks in the drawer-sides, the bearing members and said guide members serving to support and guide the drawer during opening and closing movement thereof.

Preferably also each of said tracks is provided with longitudinal lips projecting across the mouth of the track towards one another so as to form a relatively narrow entrance thereto, the bearing members on the associated runners having a height greater than the height of said entrance, whereby said lips limit lateral movement of the bearing members relative to the associated tracks. The bearing members may comprise one or more rollers or a slide arrangement.

Preferably also the drawer runners are of angle section, each having a mounting flange adapted to be supported in a cabinet or like structure in which the drawer is to be mounted in use, and a drawer-engaging flange projecting at right angles to the mounting flange and adapted to extend into the track in the associated side of the drawer through the narrow entrance thereof, one of said flanges rotatably supporting said bearing member with its central axis disposed in the plane of the drawer-engaging flange. In this case said guide members are preferably provided with outwardly opening slots adapted to receive the drawer-engaging flanges of the associated runners and to ride along same during opening and closing movements of the drawer.

Preferably also said guide members are arranged to be interchangeable between left and right hand sides of the drawer.

An embodiment of the invention will now be described, by way of example only, with reference to the accompanying drawings, in which.

Figure 1:
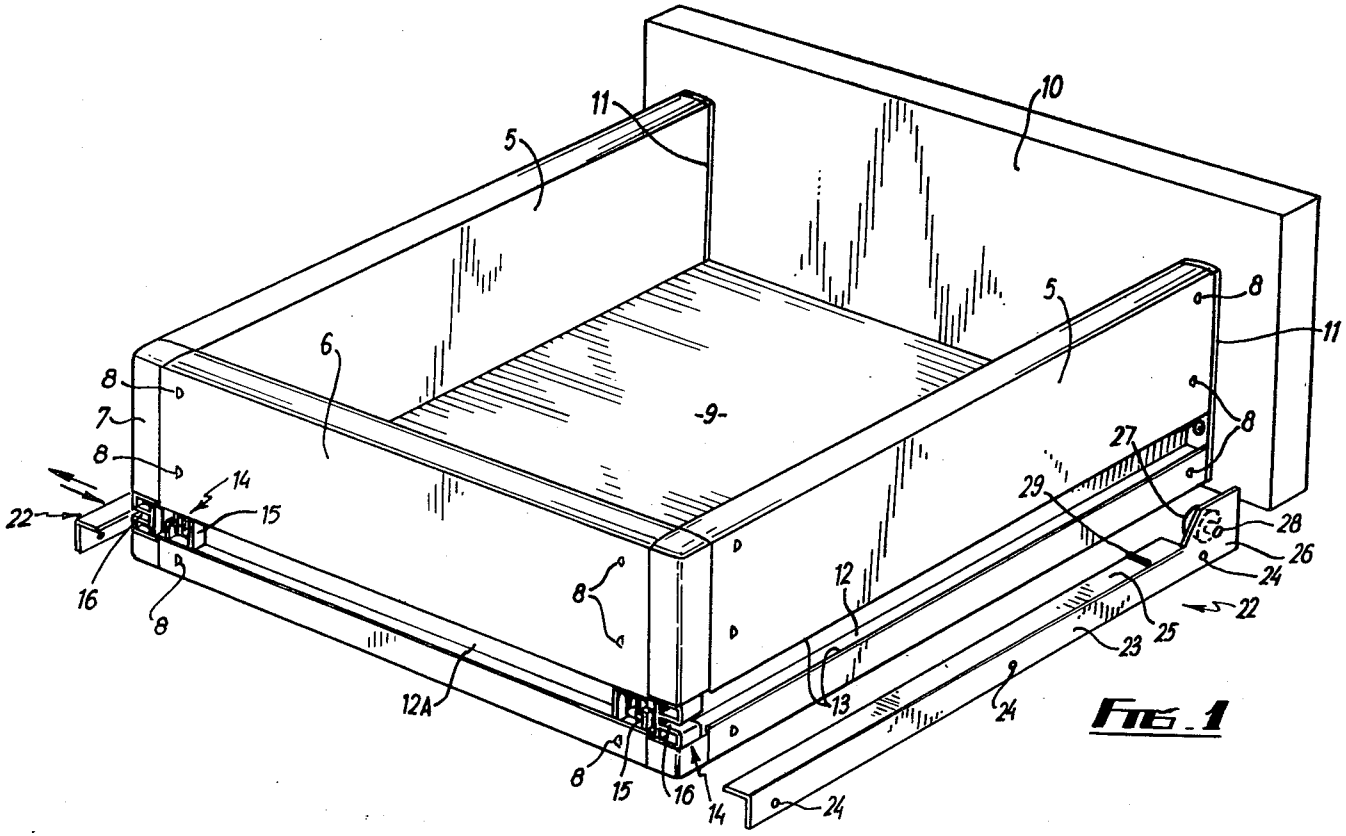
FIG. 1 is a perspective view of a drawer and runner assembly according to the invention showing rear guide members in their operative positions.
Figure 2:
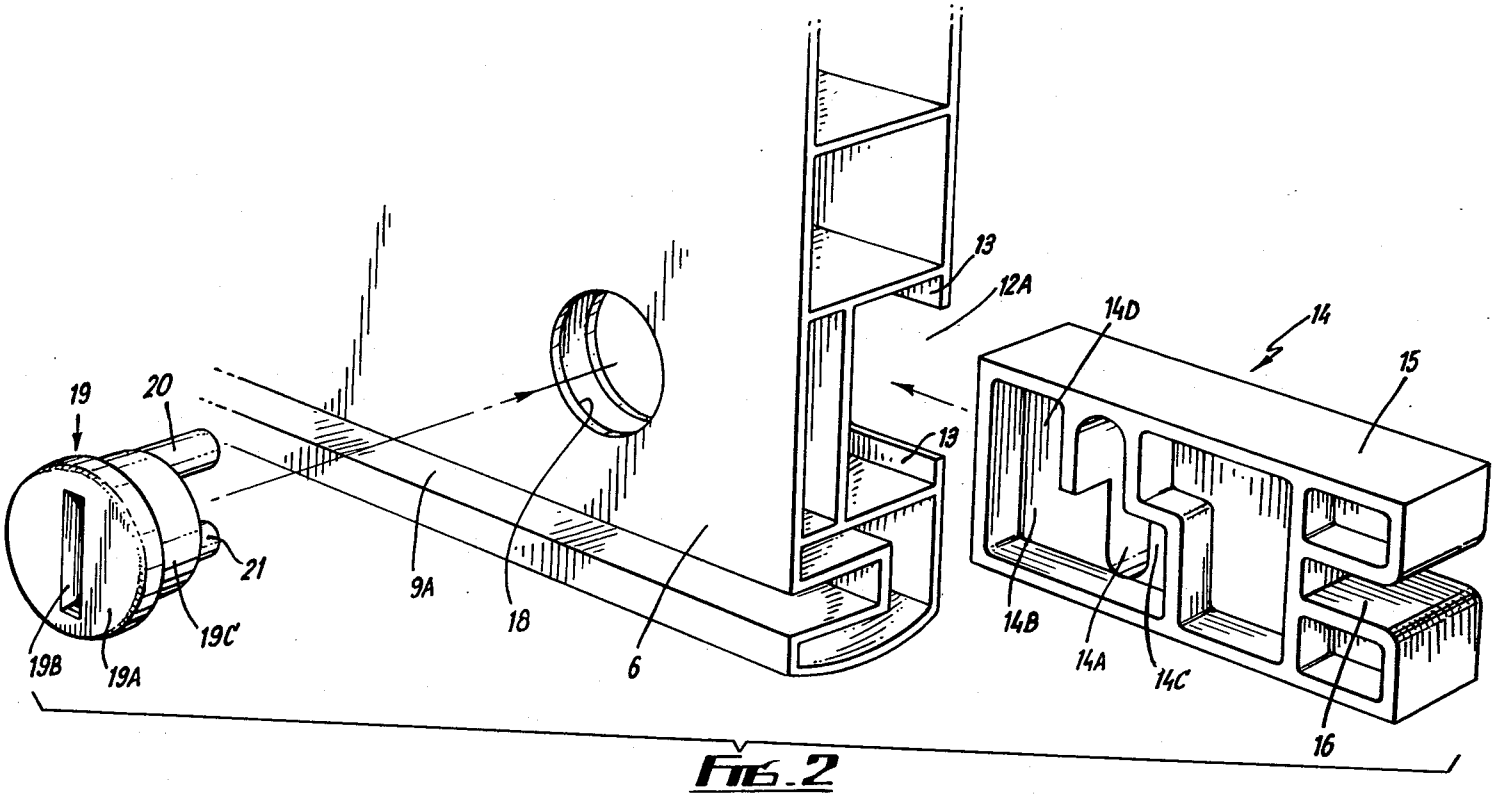
FIG. 2 is a fragmentary perspective view of one end of the rear wall panel of the drawer showing the associated guide member and actuating means detached therefrom.
Figure 3:
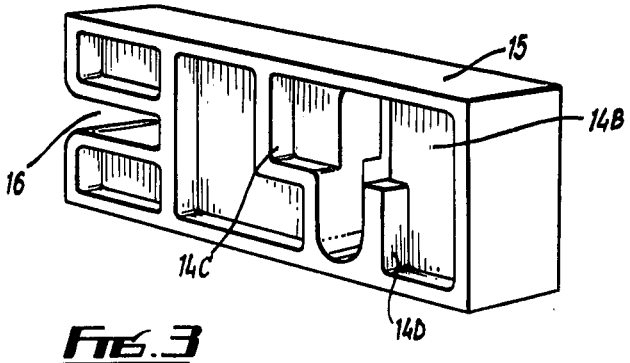
FIGS. 3 and 4 are perspective views of the rear guide members.
Figure 4:
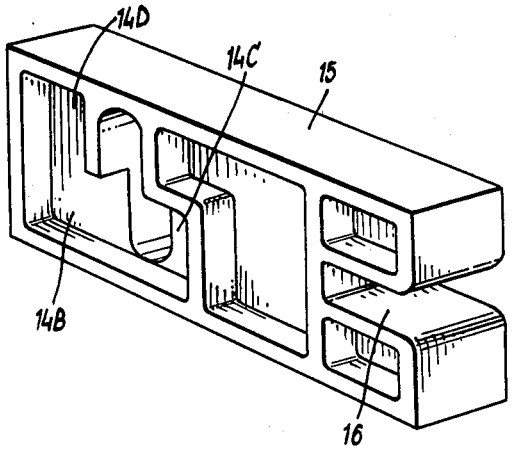
Figure 5:
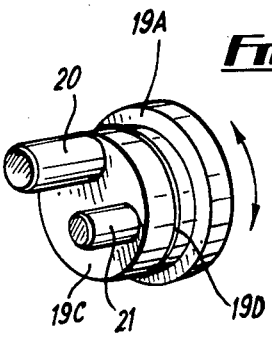
FIGS. 5 and 6 are perspective view of the actuating means.
Figure 6:
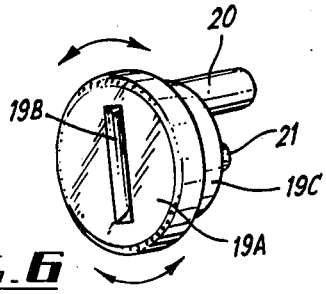

Referring to the drawings, the drawer is of so called "knock-down" form and comprises extruded side wall panels 5 and an extruded back wall panel 6 interconnected by corner pieces 7 having spigot members (not shown) projecting therefrom in two directions at right angles and provided with detents 8 which engage in holes adjacent the ends of the associated wall panels to connect them to one another at right angles. The wall panels are provided with inwardly directed slots 9A (FIG. 2) adapted to receive and support the edges of a drawer base 9, and a drawer front 10 is connected to the sides by means of front connectors 11 which are screwed to the rear face of the drawer front and have spigots projecting therefrom which engage in the open ends of the extruded side wall panels 6 and are provided with detents 8 which engage in holes in the side wall panels to secure the drawer front thereto. The drawer front is also provided with a slot to receive and support the forward edge of the drawer base 9.

A longitudinal track or channel 12 is provided in the outer face of each of the side wall panels 5 and has upper and lower lips 13 which project across the mouth of the track 12 towards one another so as to partially close same and define a relatively narrow entrance to the track.

The drawer is mounted in a cabinet or like supporting structure in which it is to be located in use by means of a pair of runners 22 each of which is of angle section and comprises a mounting flange 23 provided with holes 24 at intervals therealong enabling the runner to be screwed or otherwise secured in a suitable position in the drawer cabinet. The runner also includes a drawer engaging flange 25 projecting at right angles from the mounting flange 23 and adapted to extend into the track 12 in the associated side of the drawer through the narrow entrance thereto.

The mounting flange 23 extends beyond the drawer-engaging flange 25 at its forward end and the extension 26 supports a bearing member in the form of a roller 27 rotatably mounted on a pin 28. The axis of the pin 28 lies in the plate of the drawer-engaging flange 25 and the latter is provided with a stop member 29 comprising a projection on the upper surface of the flange adjacent its forward end. The diameter of the roller 27 is such that when engaged in the associated track 12 in the side of the drawer the roller may move along the track but is retained against lateral movement relative to the track by the projecting lips 13.

A track or channel 12A similar to the tracks 12 is formed in the back wall panel 6, and rear guide members 14 are slidably received in the opposite ends of the channel 12A. Each guide member includes a body portion 15 which is retained and guided in the channel 12A by the lips 13 and incorporates an outwardly directed slot 16 adapted to engage wth the associated drawer runner. The body portion 15 is engaged by an actuating member 19 rotatably received in an aperture 18 formed in the rear wall of the channel 12A, the arrangement being such that the actuating member 19 is accessible from the inside of the drawer.

The actuating member 19 comprises a stud-like device having a head 19A which abuts against the inner face of the back wall panel 6 and is provided with a slot 19B engageable by the edge of a coin or other suitable tool to enable rotation of the actuating member. The actuating member also incorporates a body portion 19C which is rotatably supported in the aperture 18, and pins 20 and 21 project from the end of the body portion 19C opposite so that carrying the head 19A. Each of the guide members 14 incorporates a through slot 14A which is engaged by the pin 20 of the associated actuating member 19. The pin 20 is eccentric to the central axis of rotation of the actuating member 19 and hence rotation of the actuating member moves the pin 20 in an arc and causes the guide member 14 to slide along the channel 12A between extended and retracted positions.

In order to lock the guide member in its extended and retracted positions the pin 21 of the actuating member 19 seats within a recess 14B formed in the face of the guide member which is directed towards the actuating member. When the guide member is in its retracted position the pin 21 locates in the corner 14C of the recess 14B. As the guide member is moved to its extended position the pin 21 moves within the recess 14B until it engages in the corner 14D. In both positions the pin 21 is positioned over-centre relative to the pin 20 and locks the guide member in its outer and inner positions until released by contra-rotation of the actuating member 19.

It should be noted that the guide member 14 is provided with a recess 14B on each of its opposite faces and is completely non-handed, that is to say it may be used at either of the rear corners of the drawer and will engage correctly with the actuating device 19 provided the slot 16 for engagement with the drawer runner is directed outwardly and irrespective of whether the guide member is inverted. An annular projection 19D is provided on the body portion 19C of the actuating member 19 for engagement with the edge of the aperture 18 in order to retain the actuating device in position on the wall panel.

In use of the drawer assembly the runners 22 are mounted in suitable positions in a cabinet or other supporting structure and the actuating members 19 are rotated to move the guide members 14 to their retracted positions in which they are clear of the rear ends of the tracks 12 in the sides of the drawer. The drawer may then be engaged in the cabinet by introducing the rollers 27 into the tracks 12 from the rear. Once the rollers have been introduced into the tracks the actuating members 19 are rotated to move the guide members 14 into their extended operative positions in which they project across the rear ends of the associated tracks 12 and prevent disengagement of the drawer from the runners. The slots 16 in the guide members 14 engage the drawer-engaging flanges 25 of the associated runners and slidably guide and support the rear end of the drawer on the runners. The forward end of the drawer is supported on the rollers 27. When the actuating members 19 are rotated to their operative position the locking pins 21 retain the guide members against inward movement as previously described.

Although the rear guide members 14 would act as drawer stops preventing complete withdrawal of the drawer from the cabinet, it is desirable in practice to limit the extent to which the drawer can be moved out of the cabinet in order to reduce the strain on the structure in the open position, especially when the drawer is heavily loaded. This is effected by means of the stop members 29 on the runners which abut the associated guide members 14 when the drawer has been moved out of the cabinet to the desired maximum extent and prevent further withdrawal. If it is desired to remove the drawer entirely from the cabinet it is moved to its open position, the actuating members 19 are rotated to move the guide members 14 to their retracted positions clear of the rear ends of the tracks 12 and the drawer may then be pulled clear of the cabinet since the retracted guide members 14 can pass the rollers 27.

Figure 7:
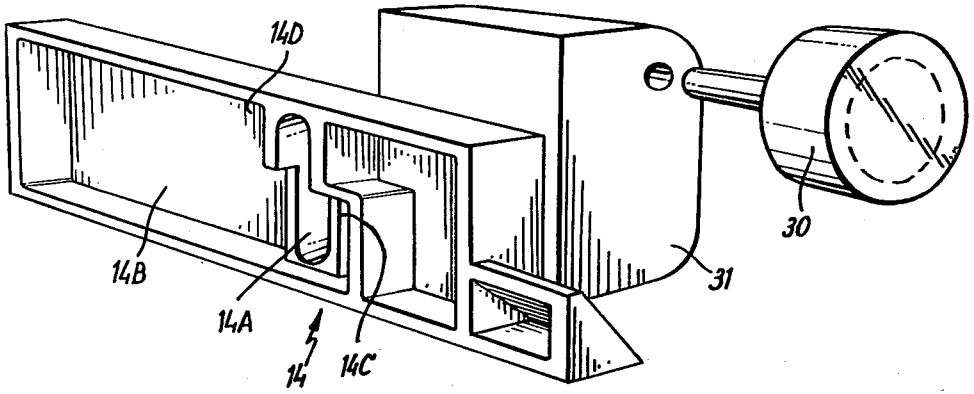
FIGS. 7 to 9 are views similar to FIG. 4 showing modifications.
Figure 8:
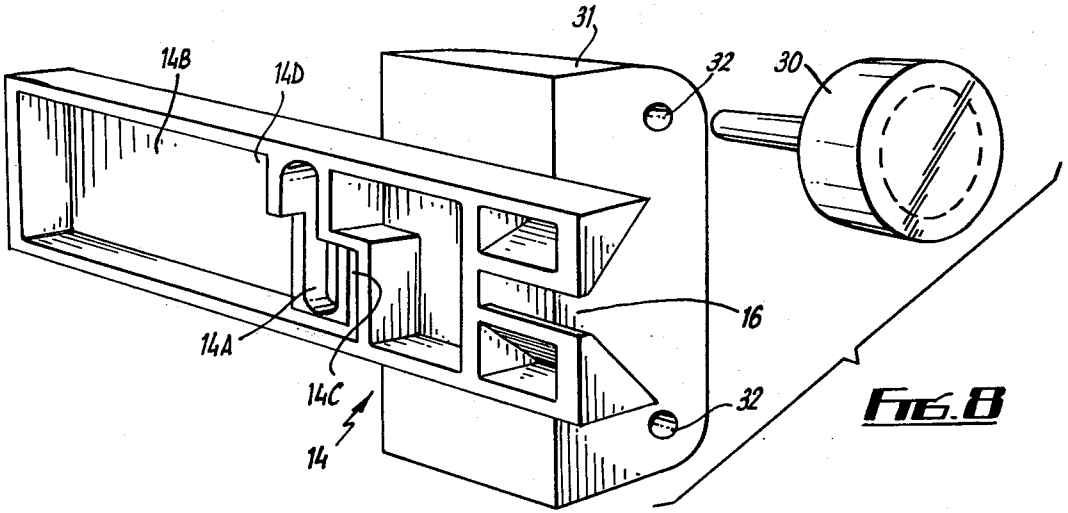
Figure 9:
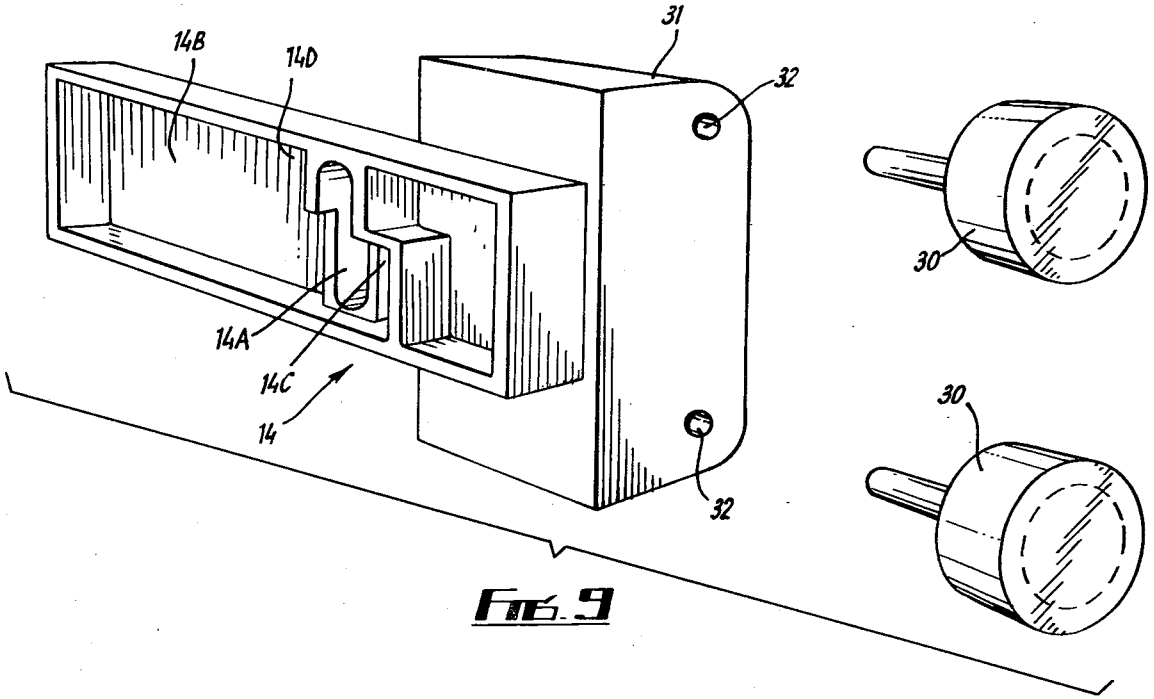

Referring to FIGS. 7 to 9 there are shown modified forms of guide member 14. In the modification shown in FIG. 7 the upper portion of the guide is replaced by a roller 30 mounted on a support block 31 secured to the rear face of the guide member. In use the roller rolls along the upper surface of the drawer engaging flange 25 of the runner 22 so that the drawer is supported by two front rollers 27 carried by the respective runners 22 and two rear rollers 30 carried by the guide members 14. Advantageously all these rollers may be of the same diameter.

The guide member shown in FIG. 7 is only suitable for use at one side of the drawer and an oppositely handed component is required at the other side. This requires the use of two separate moulding tools which increase the manufacturing cost and is also somewhat inconvenient is requiring the supply and fitting of two different components. This problem is resolved by the modified guide members shown in FIGS. 8 and 9.

In FIG. 8 the support block 31 is extended compared with the FIG. 7 arrangement and is provided with alternatively useable apertures 32 to receive the roller 30. In this way left or right hand components can be produced from a single moulding tool by inserting the wheel in the appropriate aperture. In use the roller runs on the upper surface of the runner in the same manner as the arrangement shown in FIG. 7.

FIG. 9 shows a further modification in which both portions of the forked guide are removed and replaced by upper and lower rollers 30 rotatably supported in apertures 32 in a support block similar to the one shown in FIG. 8. In this way the guide member may be inverted and used at either side of the drawer, whichever roller is uppermost riding on the upper surface of the runner to support the drawer in conjunction with the front roller 27.

It will be appreciated that a roller or rollers could be incorporated in the upper and lower portions of a forked guide of the kind shown in FIGS. 1 to 6, but these would necessarily be of very small size and would be difficult to manufacture. By virtue of the use of externally mounted rollers of the kind shown in FIGS. 7 to 9 manufacturing problems are reduced and the load carrying capability of the guide members is increased. In order to further enhance the load carrying ability the body portions 15 of the guide members shown in FIGS. 7 to 9 are of increased length compared with the FIGS. 1 to 6 arrangement, thereby deriving increased resistance to deflection under load by virtue of the close fitting engagement of the guide members in the track 12A in the rear wall of the drawer.

In other respects the guide members shown in FIGS. 7 to 9 are constructed and function in the manner of the guide members shown in FIGS. 1 to 6 and the same reference numerals have been used to refer to corresponding parts.

When the drawer is despatched from the factory, the rear wall panel is fitted with the guide members 14 and actuating members 19 together with the rear corner pieces 7 which form a unitary assembly without separable parts which could become detached or lost. Assembly of the drawer is then completed simply by attaching the sides, base and front. The assembled drawer can then be rapidly and simply mounted in position in a cabinet or the like by engagement with the runners and rotation of the actuating devices 19 to move the guide members 14 to their operative positions.

Various modifications may be made without departing from the invention. For example while in the arrangements described the drawer is constructed from extruded panels interconnected by corner pieces, the invention could be applied to drawers of more conventional construction. The rear guide members need not be accommodated in channels in the rear wall of the drawer but could be attached to the outer or inner surface thereof and arranged in the latter case to project through suitable openings in the rear ends of the side walls. The runners could also be differently constructed and the roller may be replaced by a plurality of rollers or by a slide arrangement or other front bearing member. Moreover while reference has been made herein primarily to retactable members in the form of guide members, the retractable members may serve as stop members or for other purposes.

We claim:

1. A drawer having longitudinal tracks in the opposite side walls thereof, a pair of members mounted one at each of the rear corners of the drawer and moveable between extended and retracted positions, said members being arranged to extend across the rear ends of the respective tracks in their operative positions and being arranged to retract clear of the rear ends of the tracks in their inoperative positions, and rotary actuating means accessible from within the drawer and operable to effect movement of said members between said positions, said actuating means comprising a stud device having a head adapted to seat against the inner surface of the rear wall of the drawer and provided with a formation engageable by an actuating member or tool to enable rotation of the actuating device from within the drawer, a body portion rotatably received in an aperture in said rear wall, and an eccentric pin projecting from said body portion into engagement with the associated member to impart sliding movement thereto on rotation of said stud device, and said actuating means incorporating over-centre locking means operable to retain said members in their extended operative positions until released by rotation of the actuating means.

2. A drawer according to claim 1 wherein the rear wall of the drawer is provided with a longitudinal track similar to those formed in the side walls, said members being slidably located in the track in the rear wall.

3. A drawer according to claim 1 or 2 wherein said members comprise stop members adapted in their extended positions to engage abutments serving to limit the extent to which the drawer can be opened.

4. A drawer according to claim 1 or 2 wherein said members comprise guide members adapted to their operative positions to engage with respective runners on which the drawer is slidably supported in use.

5. A drawer according to claim 1 wherein said member comprise guide members adapted in their operative positions to engage with respective runners on which the drawer is slidably supported in use.

6. A drawer according to claim 5 which is adapted to be used in association with drawer runners having bearing members mounted at the forward ends thereof and adapted to engage within said tracks in the drawer sides, the bearing members and said guide members serving to support and guide the drawer during opening and closing movement thereof.

7. A drawer according to claim 6 wherein each of said tracks is provided with longitudinal lips projecting across the mouth of the track towards one another so as to form a relatively narrow entrance thereto, the bearing members on the associated runners having a height greater than the height of said entrance, whereby said lips limit lateral movement of the bearing members relative to the associated tracks.

8. A drawer according to claim 7 and a pair of drawer runners of angle section each having a mounting flange adapted to be supported in a cabinet or like structure in which the drawer is to be mounted in use and a drawer-engaging flange projecting at right angles to the mounting flanges and adapted to extend into the track in the associated side of the drawer through the narrow entrance thereof, one of said flanges rotatably supporting said bearing member with its central axis disposed in the plane of the drawer engaging flange.

9. A drawer according to claim 5, 6 or 8 wherein said guide members are provided with outwardly opening slots adapted to engage with the associated runners and to ride along same during opening and closing movements of the drawer.

10. A drawer according to claim 5, 6 or 8 wherein each of said guide members is provided with at least one roller adapted to ride along the associated runner during opening and closing movements of the drawer.

11. A drawer according to claim 5, 6 or 8 wherein each of said guide members is provided with a single roller detachably mounted on the associated guide member, the guide member having alternative mounting points enabling said roller to be mounted in different positions dependent on whether the guide member is to be used at the left or right hand side of the drawer.

12. A drawer according to claim 5, 6 or 8 wherein said guide members are arranged to be interchangeable between left and right hand sides of the drawer.

13. A drawer according to claim 5, 6 or 8 wherein each of said guide members is provided with a pair of rollers adapted to locate above and below the associated runner during opening and closing movements of the drawer.

* * * * *